US005507335A

United States Patent [19]

Yu

[11] Patent Number: 5,507,335

[45] Date of Patent: Apr. 16, 1996

[54] SLAT UNITS WITH TRANSPARENT PORTIONS

[76] Inventor: Jackson Yu, 2F, No. 2, Chung-Hua St., Pei-Tou Dist., Taipei City, Taiwan

[21] Appl. No.: 305,376

[22] Filed: Sep. 13, 1994

[51] Int. Cl.[6] ..... F06B 3/12

[52] U.S. Cl. ..... 160/235; 160/236

[58] Field of Search ..... 160/235, 236, 160/232, 133, 32, 201, 173 R, 173 V, 229.1; 312/297

[56] References Cited

U.S. PATENT DOCUMENTS

| | | | |
|---|---|---|---|
| 2,275,975 | 3/1942 | McGlone | 160/236 |
| 2,341,233 | 2/1944 | Norton | 160/236 |
| 2,447,706 | 8/1948 | Marston | 160/236 X |
| 2,926,729 | 3/1960 | Zanini | 160/236 |
| 4,333,509 | 6/1982 | Conn | 160/236 X |
| 4,345,635 | 8/1982 | Solomon | 160/236 X |
| 5,236,260 | 8/1993 | Yu . | |

*Primary Examiner*—David M. Purol

*Attorney, Agent, or Firm*—Oblon, Spivak, McClelland, Maier, & Neustadt

[57] ABSTRACT

A shutter includes a plurality of juxtaposed slat units. Each of the slat units includes at least two separate elongated parts which are disposed in alignment and which are connected to each other by male-female connection unit. At least one of the two parts is being transparent. A pin-and-eye assembly engages juxtaposed two of the slat units such that the transparent part of one of the slat units is aligned with the transparent part of an adjacent slat unit.

4 Claims, 4 Drawing Sheets

SLAT UNITS WITH TRANSPARENT PORTIONS

BACKGROUND OF THE INVENTION

1. FIELD OF THE INVENTION

The invention relates to a shutter for a cabinet, more particularly to a shutter with a plurality of slat units which have transparent portions through which an object behind the same can be viewed.

2. DESCRIPTION OF THE RELATED ART

According to U.S. Pat. No. 5,236,260, there is disclosed a cabinet (not shown) which has an entrance and a drawable shutter to close the entrance.

Referring to FIGS. 1 and 2, a conventional shutter (S) employed in the previously described cabinet is shown to comprise a plurality of juxtaposed slat units 3. Each of the slat units 3 has a front face (f), a back face (b), a longitudinal first portion 31, a longitudinal second portion 32, a longitudinal intermediate portion 33 between the longitudinal first and second portions 31, 32, a longitudinal rib 34 which projects from the back face (b) at the intermediate portion 33, and a pin-and-eye assembly which includes a pin member 35 provided on the back face (b) of the first portion 31 and which extends in a direction substantially parallel to the rib 34, and an eye member 36 provided on the back face (b) at the second portion 32. The pin member 35 of one of the slat units 3 engages the eye member 36 of an adjacent one of the slat units 3 so as to hinge the slat unit 3 to an adjacent slat unit 3. The slat units are hinged compactly so that no clearance is formed between adjacent slat units when the slat units are extended to prevent dust from entering into the cabinet.

Some of the drawbacks of the above-described shutter (S) are as follows:

(I) A large mold is needed to form a slat unit with a considerable length, thereby increasing the production costs incurred.

(II) Since the slat unit is made of an opaque material, an object kept in the cabinet is not visible. Identification tags are generally adhered on an external surface of the slat units to identify the objects kept in the cabinet, thereby resulting in additional work to the user.

SUMMARY OF THE INVENTION

A main objective of the present invention is to provide a shutter for a cabinet with a plurality of slat units which can be produced easily at a relatively low cost.

Another objective of the present invention is to provide a shutter with slat units that are at least partially transparent so that an object behind the same can be viewed.

According to the present invention, a shutter for a cabinet includes a plurality of juxtaposed slat units. Each of the slat units has a front face, a back face, a longitudinal first portion, a longitudinal second portion, a longitudinal intermediate portion between the longitudinal first and second portions, a longitudinal rib which projects from the back face at the intermediate portion, and a pin-and-eye assembly which includes a pin member provided on the back face of the first portion and which extends in a direction substantially parallel to the rib, and an eye member which is provided on the back face at the second portion. The pin member of one of the slat units engages the eye member of an adjacent one of the slat units so as to hinge the slat unit to the adjacent slat unit.

In the present invention, each of the slat units is formed by at least two separate elongated parts which are disposed in alignment and which are connected to each other by male-female connection means. At least one of the two parts is transparent. The transparent part of a slat unit is disposed in alignment with a corresponding transparent part of an adjacent slat unit. In one embodiment, each of the slat units includes three separate parts, the transparent part being disposed at an intermediate thereof while the remaining two parts are opaque and are disposed at two opposed end portions of the transparent part, and two sets of pin-and-eye assemblies. Each of the sets of pin-and-eye assemblies is mounted on the back face of each of a respective one of the remaining two parts. The male-female connection means includes a projection and a recess formed at two end portions of the transparent part. One end portion of one of the remaining two parts has another projection fixed within the recess in the transparent part. One end portion of the other one of the remaining two parts has another recess engaging the projection of the transparent part. Optionally, two of the three parts can be made transparent and disposed at two sides of an opaque part in order to increase the size of the transparent area so as to facilitate viewing of an object behind the shutter. When thus provided, the pin-and-eye assemblies are preferably mounted on the back face of the opaque parts such that the transparent parts can provide a clear view of an interior of the cabinet.

The projection is preferably provided with a distal enlarged head which has an axial slot extending therethrough. The recess is preferably confined by a peripheral wall with a width sufficient to permit resilient extension of the enlarged head interiorly of the peripheral wall and engages therein.

Note that a small mold is required to produce the separate parts. It is cheaper to construct a small mold when compared to a large mold. Since the corresponding transparent parts are aligned with one another, one can easily see an object behind the same. Thus, there is no need to attach identification tags on the external surface of the slat units when the present invention is in use.

BRIEF DESCRIPTION OF THE DRAWINGS

Other features and advantages of the present invention will become more apparent in the following detailed description of the preferred embodiment with reference to the accompanying drawings, in which.

DETAILED DESCRIPTION OF THE PREFERRED EMBODIMENT

Figure 1:
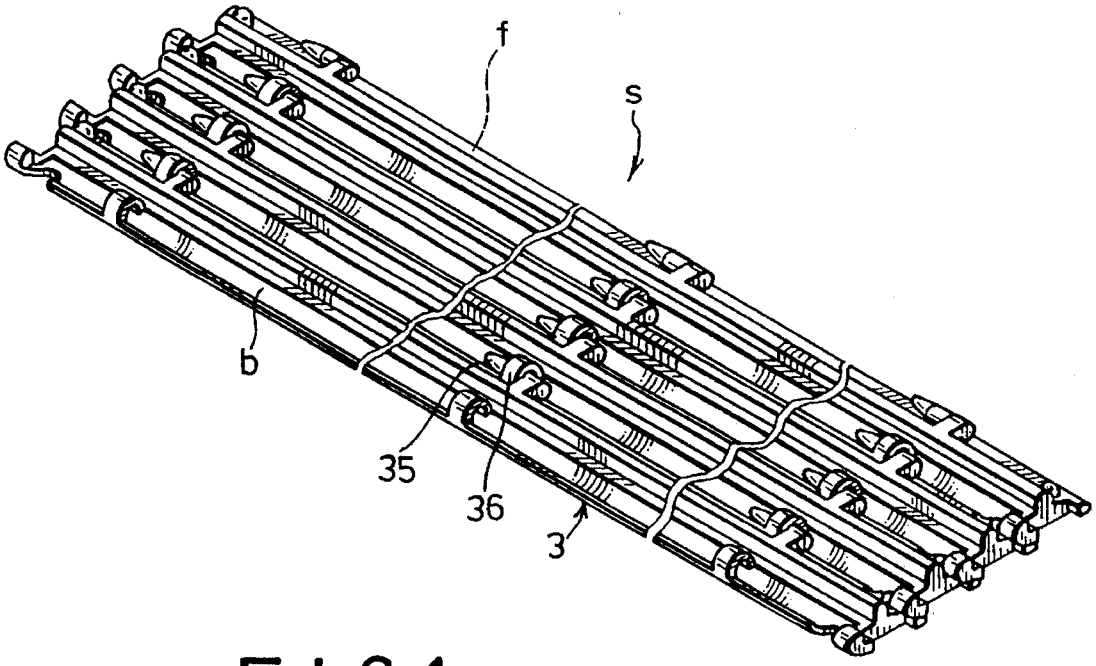
FIG.1 (PRIOR ART)
FIG. 1 shows a shutter for a cabinet according to U.S. Pat. No. 5,236,260.
Figure 2:
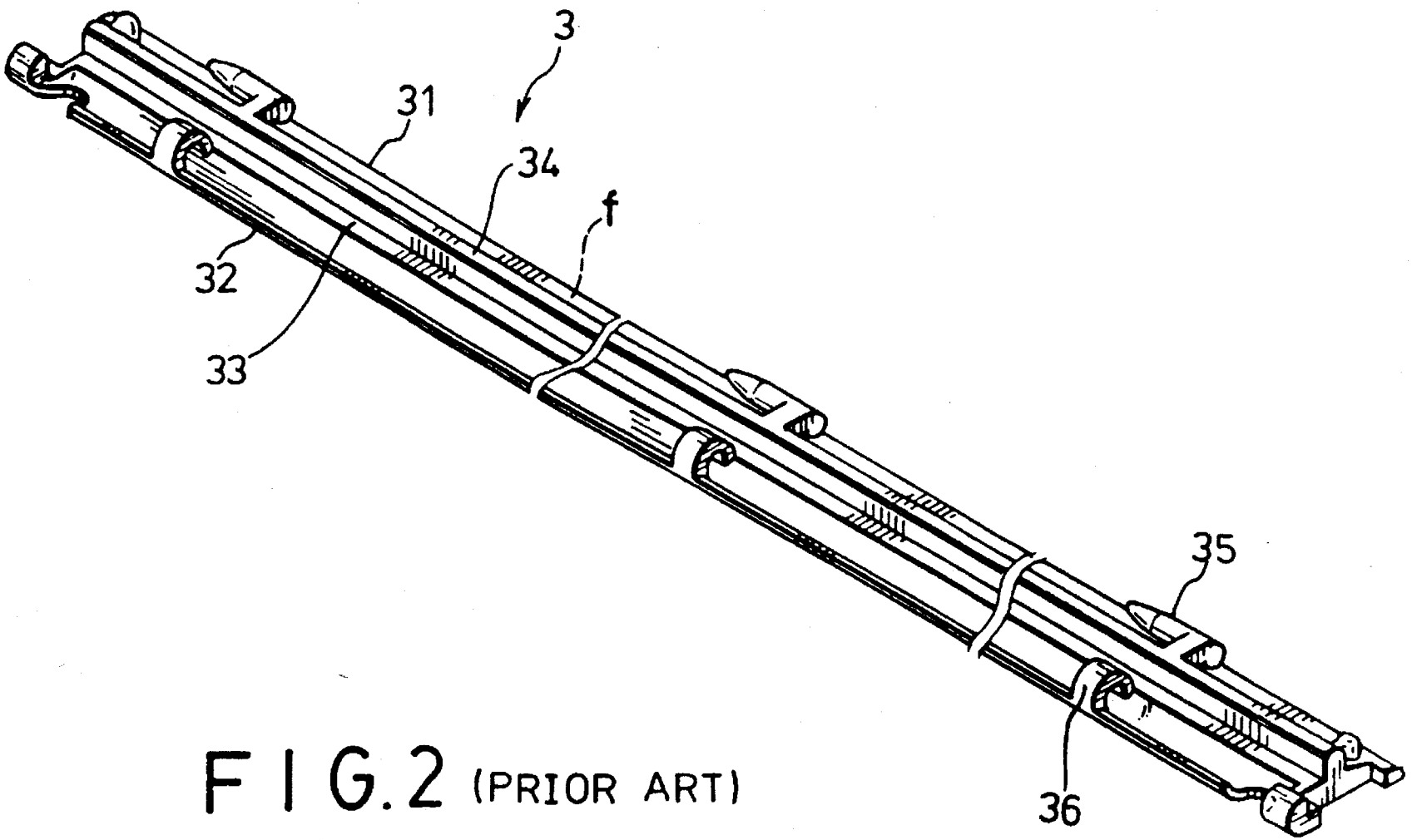
FIG. 2 (PRIOR ART)
FIG. 2 shows a slat unit of the shutter illustrated in FIG. 1.
Figure 3:
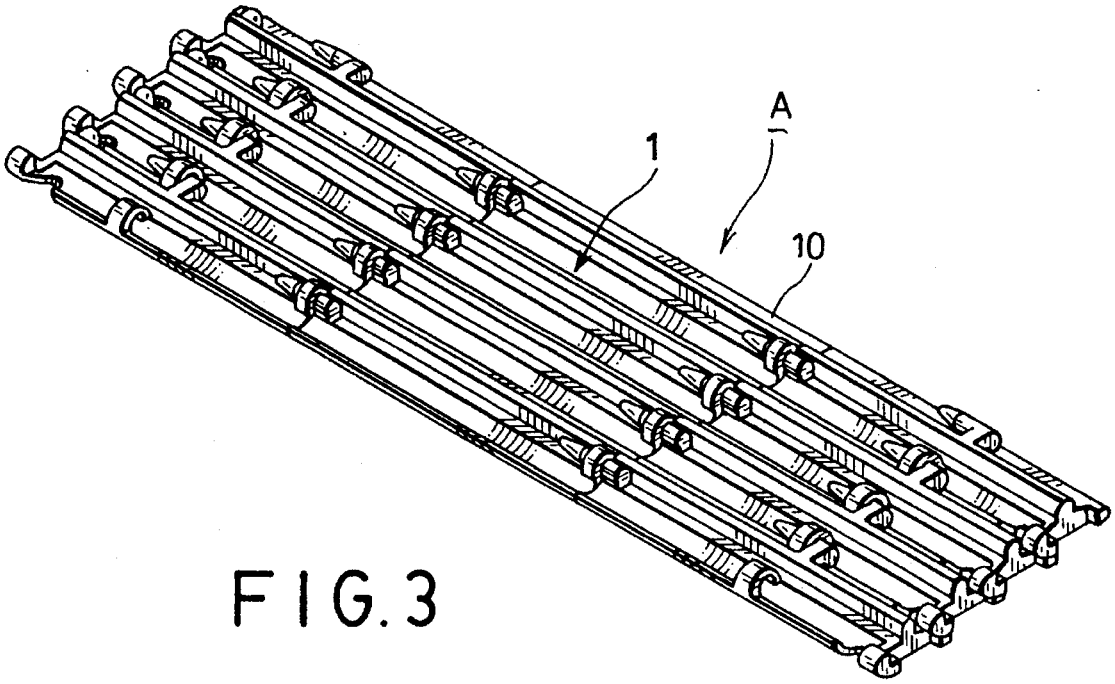
FIG. 3 shows an assembled view of a shutter for a cabinet according to the present invention.
Figure 4:
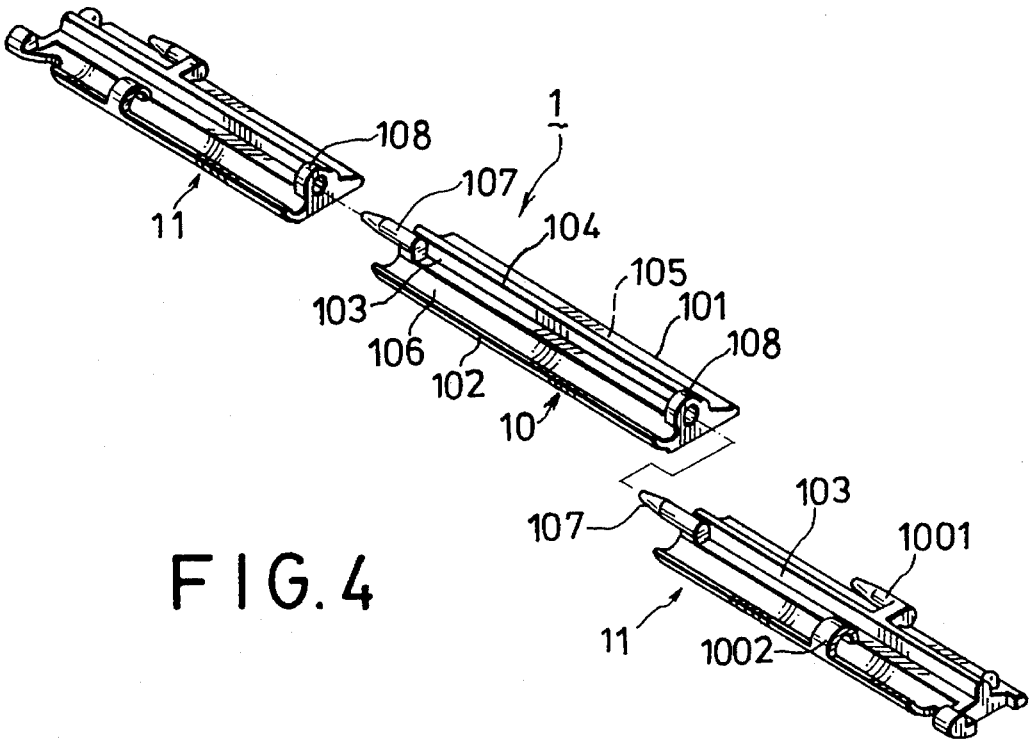
FIG. 4 shows a slat unit of the shutter of the present invention.
Figure 5:
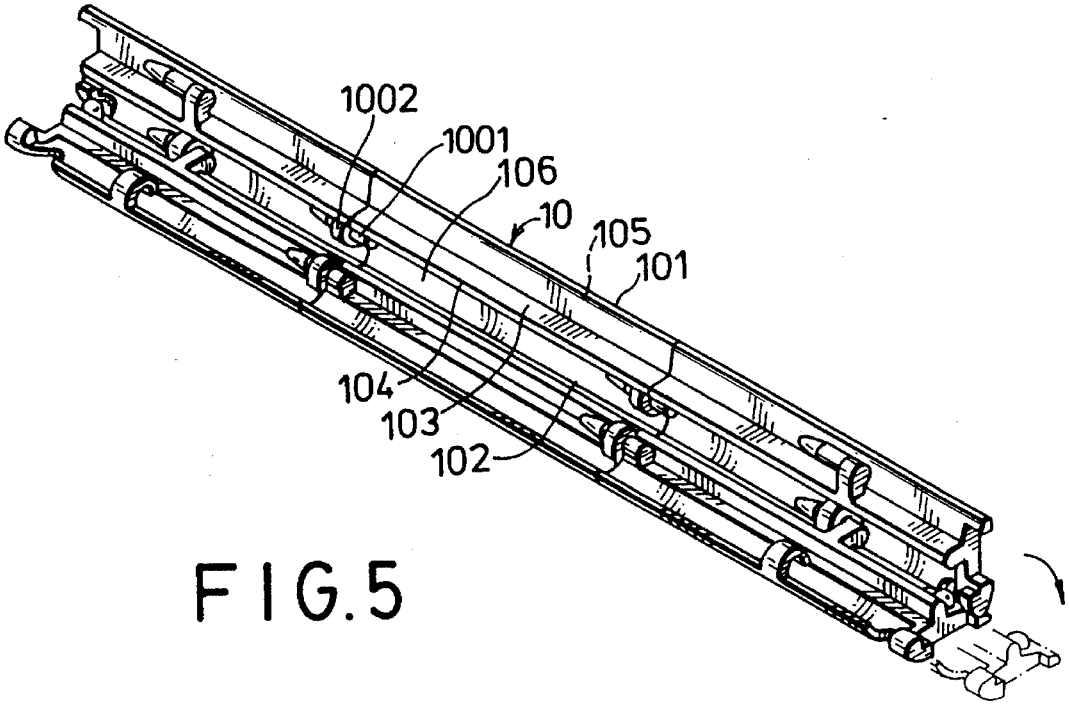
FIG. 5 shows the slat units of FIG. 4 when assembled to form the shutter of the present invention.

A shutter "A" according to the present invention is to be employed in the previously described cabinet for closing the entrance thereof. Referring to FIGS. 3 to 5, the shutter (A)

includes a plurality of juxtaposed slat units 1. Each of the slat units 1 has a front face 105, a back face 106, a longitudinal first portion 101, a longitudinal second portion 102, a longitudinal intermediate portion 103 between the longitudinal first and second portions 101, 102, and a longitudinal rib 104 which projects from the back face 106 at the intermediate portion 103.

Each of the slat units 1 is constituted by an elongated transparent part 10 and two elongated opaque parts 11 which are disposed in alignment and which are connected to each other by male-female connection means. The male-female connection means includes a projection 107 which is formed at one end portion of the transparent part 10, and a recess 108 which is formed in the other end portion of the transparent part 10. One end portion of one of the opaque parts 11 is provided with a projection 107 identical to that of the transparent part 10, while one end portion of the other one of the opaque parts 11 is provided with a recess 108. The projection 107 and the recess 108 of the transparent part 10 engage respectively the recess 108 and the projection 107 of the opaque parts 11 when the three parts 10, 11 are disposed in alignment.

Figure 6:
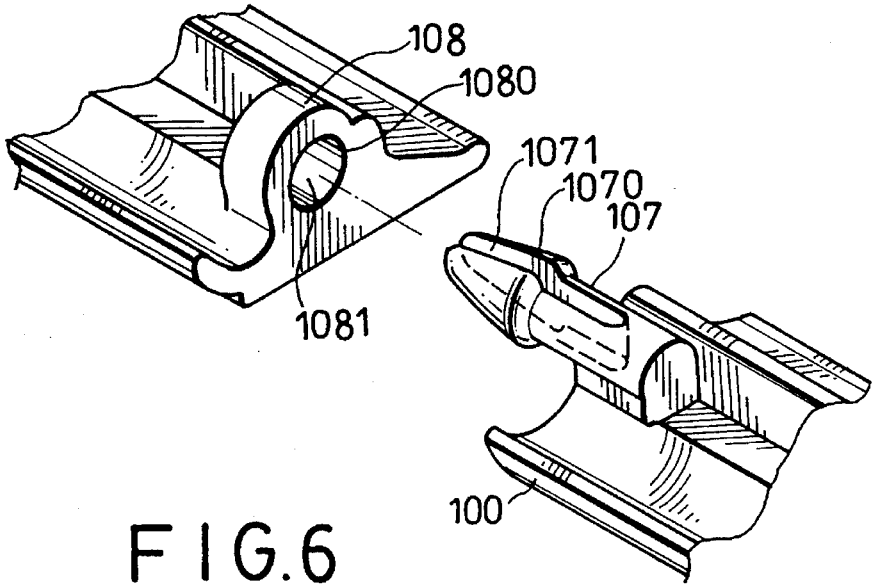
FIG. 6 is an enlarged view of a male-female connection means employed in the slat unit shown in used in FIG. 4.

Referring to FIG. 6, the projection 107 is preferably provided with a distal enlarged head 1070 which has an axial slot 1071 extending therethrough. The recess 108 is preferably confined by a peripheral wall 1080 with an opening 1081 through which the enlarged head 1070 squeezes resiliently therethrough so that the enlarged head 1070 engages therein. When desired, the enlarged head 1070 can be pulled outward so as to disengage the recess 108 by clamping the head 1070 inwardly thereof.

Note that each of the opaque parts 11 has one set of pin-and-eye assembly which includes a pin member 1001 provided on the back face 106 of the first portion 101 and which extends in a direction substantially parallel to the rib 103, and an eye member 1002 provided on the back face 106 of the second portion 102. The pin member 1001 of one of the opaque parts 11 engages the eye member 1002 of an adjacent one of the opaque parts 11 so as to hinge the slat unit 1 to an adjacent slat unit 1. Under such a condition, the transparent part 10 of one of the slat units 1 is aligned with the transparent part 10 of an adjacent one of the slat units 1. Thus, an object which is kept within a cabinet (not shown) that is closed by the shutter (A) of the present invention can be viewed through the transparent parts 10.

Note that a small mold is needed when forming the transparent and opaque parts 10, 11 because of the relatively short lengths of the latter. Thus, the cost of the mold for producing of the parts 10, 11 is lower. In addition, unlike the previously described conventional shutter (S), the user of the shutter (A) of this present invention has no need to attach identification tags on the external surface of the slat unit 1.

With the present invention thus explained, it is obvious to those skilled in the art that various modifications and variations can be made without departing from the scope and spirit of this invention. It is therefore intended that the invention is not to be limited to the exact disclosure but only in the appended claims.

I claim:

1. A shutter for a cabinet, comprising:

a plurality of juxtaposed slat units, each of said slat units having a front face, a back face, a longitudinal upper portion, a longitudinal lower portion, a longitudinal intermediate portion between said longitudinal upper and lower portions, a longitudinal rib projecting from said back face at said intermediate portion, at least one set of pin-and-eye assembly which includes a pin member provided on said back face of said upper portion and extending in a direction substantially parallel to said rib, and an eye member provided on said back face at said lower portion;

said pin member of one of said slat units engaging said eye member of an adjacent one of said slat units so as to hinge said one of said slat units to said adjacent one of said slat units;

each of said slat units being formed by at least two separate elongated parts which are disposed in alignment and which are connected to each other by male-female connection means;

said male-female connection means including a projection formed at one end of portion of one of said parts, a recess formed at one end portion of the other one of said parts to receive detachably said projection therein, said projection having a distal enlarged head with an axial slot extending therethrough, said enlarged head extending resiliently into and engaging said recess; and at least one of said two parts being made of a transparent material.

2. The shutter as defined in claim 1, wherein said transparent part of one of said slat units is disposed in alignment with said transparent part of an adjacent one of said slat units.

3. The shutter as defined in claim 1, wherein each of said slat units includes three separate parts, said transparent part being disposed at an intermediate thereof while remaining two parts are disposed at two opposed end portions of said transparent part.

4. The shutter as defined in claim 3, wherein each of said slat units further includes two sets of pin-and-eye assemblies, each of which is mounted on said back face of a respective one of the remaining said two parts.

* * * * *